US007186186B2

(12) United States Patent
Imahata

(10) Patent No.: US 7,186,186 B2
(45) Date of Patent: Mar. 6, 2007

(54) GAME APPARATUS HAVING A BALL DROP MECHANISM

(76) Inventor: Takeo Imahata, 7390 Woodsboro Ave., Anaheim, CA (US) 92807

( * ) Notice: Subject to any disclaimer, the term of this patent is extended or adjusted under 35 U.S.C. 154(b) by 0 days.

(21) Appl. No.: 11/041,718

(22) Filed: Jan. 22, 2005

(65) Prior Publication Data

US 2006/0166756 A1 Jul. 27, 2006

(51) Int. Cl.
*A63B 53/00* (2006.01)
*A63B 57/00* (2006.01)

(52) U.S. Cl. ..... 473/282; 473/132; 221/268; 221/299

(58) Field of Classification Search ..... 473/132–137, 473/282; 221/133, 268, 299, 252
See application file for complete search history.

(56) References Cited

U.S. PATENT DOCUMENTS 6,440,007 B1 * 8/2002 Imahata ..... 473/282
6,488,593 B2 * 12/2002 Imahata ..... 473/282

* cited by examiner

*Primary Examiner*—Stephen Blau
(74) *Attorney, Agent, or Firm*—Muramatsu & Associates

(57) ABSTRACT

A ball drop mechanism for a game apparatus has a mechanism allowing to drop balls one by one on a desired location. The ball drop mechanism includes a housing that stores balls, a cylindrical ball passage connected to the housing, and a cogged stopper that is located in the housing near the ball passage. One side of the cogged stopper has a hollowed portion that matches a circumference of the ball passage. A golf ball dispenser is established by installing the ball drop mechanism for a game apparatus. The golf ball dispenser has a plurality of ball cylinders which install and guide a large number of golf balls and has a golf ball placer with a seesaw movement mechanism to place a ball accurately on the ground.

9 Claims, 15 Drawing Sheets

GAME APPARATUS HAVING A BALL DROP MECHANISM

FIELD OF THE INVENTION

This invention relates to a game apparatus having mechanism to drop an object, and more particularly, to a ball drop mechanism for a game apparatus to drop balls on arbitrary locations with a simple structure and operation, which is suitable for use as a golf club, a golf ball dispenser or the like.

BACKGROUND OF THE INVENTION

Men and women of all ages are enjoying the game of golf these days. Golf is a game to hit the ball having a diameter of about 4 cm (centimeter) on the ground with a lesser number of strokes to put the ball in a hole or cup on the green. The game of golf can be roughly classified in its play into a process of placing the ball onto a green where a hole is provided, and a process of putting for hitting the ball on the green with a putter to bring the ball into the hole.

The practice of putting purports to put the ball, or a spherical objected placed on the ground into a hall. The putting is also enjoyed for its own sake as recreation. When a player practices putting or plays putting as recreation, the player has to place balls on the ground (placement process). Hence, in order to practice putting ten (10) times, for example, the player has to place the ball ten times. To repeat such a simple routine of placing the ball is boring and frustrating. Moreover, bending down to place a ball on the ground may pose significant difficulty for an elderly player or a player with a back pain, or a handicapped person.

A machine is desired that allows a player to place the ball easily on the ground. It is desired to achieve means for easily and automatically placing the balls on the ground without a player's action to bend over the ground to place the balls. A reliable and economical means to achieve such a purpose is desired.

SUMMARY OF THE INVENTION

Therefore, it is an object of the present invention to provide a game apparatus having mechanism to drop and place balls on the ground that is easy to use and reliable.

One object of the present invention is to provide a ball drop mechanism for game apparatus comprising: a housing into which at least one ball is stored to be later dropped to the ground; a ball passage that is a cylinder provided to the housing having an opening diameter size that is close to a diameter of a ball to be used; an upper cogged stopper that is located in the housing near the ball passage as to cut across a part of the ball passage, one side of which has cogged portion and the other end has a hollowed portion that matches a part of a ball's diameter; a lower cogged stopper that is located in the housing near the ball passage as to cut across a part of the ball passage, one side of which has cogged portion and the other end has a hollowed portion that matches a part of a ball's diameter; a gear wheel having teeth that match the cogged portion of the cogged stopper, the gear wheel is provided in the housing in a manner that gears of the gear wheel contact the cogged portion of the cogged stopper; and means to drive the gear wheel to move the cogged stoppers to release a ball.

A positional gap exists between the hollowed portion of the upper cogged stopper and the hollowed portion of the lower cogged stopper such that when the upper cogged stopper allows a ball's movement, the lower cogged stopper stops the ball's movement, and when the lower cogged stopper allows a ball's movement, the upper cogged stopper stops the ball's movement.

The means to drive a gear wheel is a lever to be operated by a user manually by turning the lever. Alternatively, the means to drive the gear wheels is a handle that transmits gripping force of a user to the gear wheels.

Another object of the present invention is to provide a ball drop mechanism for game apparatus as described above wherein the upper cogged stopper and the lower cogged stopper are combined to make an integrated cogged stopper that moves as a single unit.

Another object of the present invention is to provide a ball drop mechanism for game apparatus attached to a golf club, and has a ball guide attached above the housing along a shaft of the golf club to store balls and guide the stored balls to the housing. The handle portion of a golf club may be detachable. The ball guide may be configured to extend and shrink by a user's operation.

Another object of the present invention is to provide a ball drop mechanism for game apparatus having bucket with a hole at the bottom and stores balls to be dropped, where the ball passage of the housing is aligned to the hole, and further includes a mechanism wherein a ball placer is capable of making a seesaw movement, on end of which has a stopper to stop a ball and an opening to release a ball to the ground, and the other end has an appropriate weight, a ball receiver at the side having the opening is positioned below an opening of the housing to receive a ball released from the housing. A ball drop mechanism for game apparatus may further comprise a golf ball cylinder located between the bucket and the housing to store and guide balls.

Another object of the present invention is to provide a spherical object drop mechanism for game apparatus as described above, wherein a multiplicity of the golf ball cylinders are provided that is circularly arranged, which forms an upper portion along with a bucket, where the upper portion is rotatable.

Still another object of the present invention is to provide a mattress for placing a golf ball thereon, comprising an upper portion upon which a golf ball is placed, and a lower portion filled with liquid to have an elastic property.

According to the present invention, the (spherical object) drop mechanism is able to drop the ball one by one on a desired location on the ground. The ball drop mechanism of the present invention can be mounted on a golf club such as a putter to promote putting practice using many golf balls. The ball drop mechanism of the present invention can be mounted on a golf ball dispenser which installs a large number of golf balls and drops the ball one by one. Since the ball drop mechanism of the present invention has a simple configuration, it can achieve high reliability, ease of production, low cost, and less needs of maintenance.

BRIEF DESCRIPTION OF THE DRAWINGS

FIG. 2A is a plan view showing a cogged stopper and a gear wheel. FIG. 2B is a plan view showing a cogged stopper, a gear wheel and a ball passage in a condition where a ball is stopped by the cogged stopper. FIG. 2C is a plan view showing a cogged stopper, a gear wheel and a ball passage in a condition where a ball is allowed to pass. FIG. 2D is a plan view showing a cogged stopper, a gear wheel and a ball passage in another condition where a ball is stopped by the cogged stopper.

FIG. 10A shows a condition where an upper portion of the dispenser rotates. FIG. 10B shows the condition where a ball is released from the housing. FIG. 10C shows the condition where a ball is dropped to a receiver hole. FIG. 10D shows the condition where the ball placer is tilted to the stopper hole due to the ball's weight. FIG. 10E shows the condition where the ball placer is further tilted to the stopper hole. FIG. 10F shows the condition where the ball is dropped from the stopper hole to the ground. FIG. 10G shows the condition where the ball placer is being tilted back to the original position after the ball is released. FIG. 10H shows the condition where the ball placer is back to the original position.

DETAILED DESCRIPTION OF THE INVENTION

The structure of the ball drop mechanism in the present invention for use as a game apparatus is explained in detail with reference to the accompanied drawings. The ball drop mechanism of the present invention is designed to drop balls or other spherical objects object, typically golf balls, one by one on the ground or other desired devices in response to user's operations.

Figure 1A:
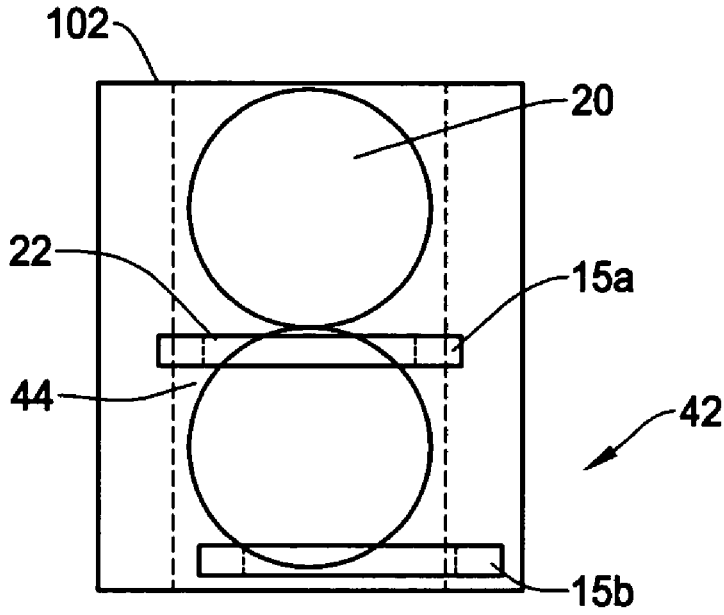
FIG. 1A is a schematic diagram showing the inside condition of a housing of the ball drop mechanism in the present invention where a lower ball is stopped while an upper ball is free to move.
Figure 1B:
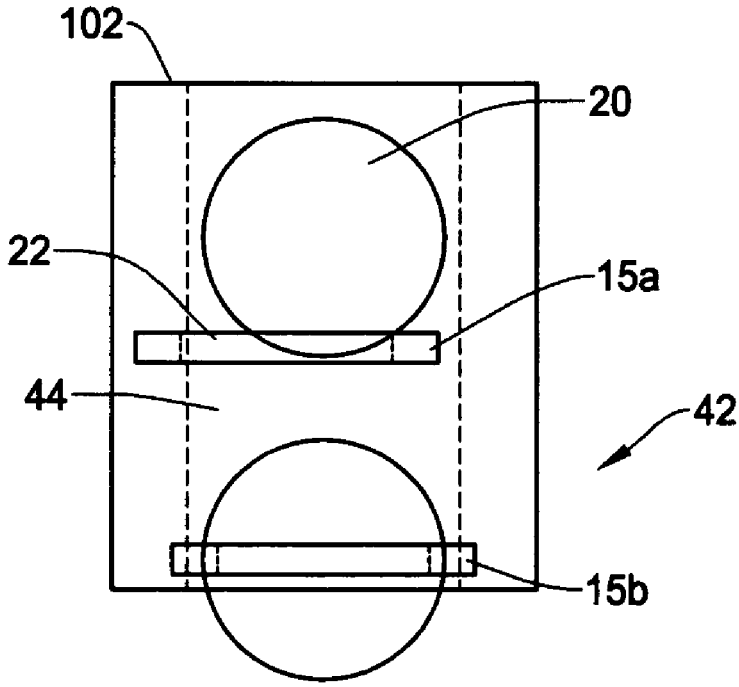
FIG. 1B is a schematic diagram showing the inside condition of the housing of the ball drop mechanism in the present invention where a lower ball is free to move while an upper ball is stopped.

Schematic diagrams showing a basic concept of the ball drop mechanism of the present invention are illustrated in FIGS. 1A and 1B. In this example, a housing 42 has a ball passage 44 that is a cylinder having a circular opening with an appropriate diameter to allow passage of a ball such as a golf ball. In FIGS. 1A and 1B, the diameter of the ball passage 44 is indicated by dotted lines. The diameter must be large enough for the golf balls to pass through, yet must be small enough to guide the ball in the ball passage 44 without unnecessary gap between the ball and the ball passage 44. In this example, two balls are shown to explain the operation of the spherical object drop mechanism in the present invention. Cogged stoppers 15*a* and 15*b* are provided inside the housing 42. They are almost identical to each other in structure as will be explained later. Although not shown in FIGS. 1A and 1B, a gear wheel is provided to each of the cogged stoppers (FIGS. 2A–2D) to move the stoppers in a horizontal directions.

Referring to FIG. 1A, the condition is shown where the lower cogged stopper 15*b* is "closed" to prevent the lower ball from falling to the ground. In this condition, the upper cogged stopper 15*a* is "opened" so the upper ball can pass through the upper cogged stopper 15*a*. However, since the lower ball is stopped, the upper ball cannot go down because of the lower ball.

Figure 2A:
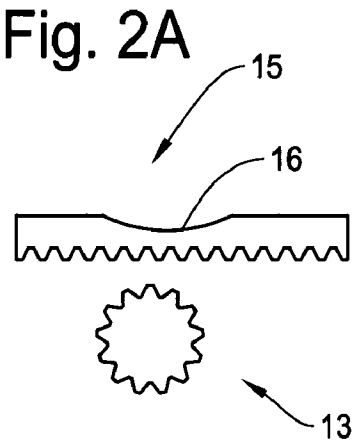
FIGS. 2A–2D show stoppers used in the ball drop mechanism of the present invention.

FIGS. 2A–2D schematically show basic operation of the stoppers used in the ball drop mechanism of the present invention. FIGS. 2A–2D are plan views showing a ball passage 44, cogged stopper 15, and a gear wheel 13 in the ball drop mechanism in the present invention. FIG. 2A shows the configuration of the gear wheel 13 and the cogged stopper 15. The cogged stopper 15 has cogs that fit to the teeth of the gear wheel 13. Thus, rotational movements of the gear wheel 13 can be transmitted to the cogged stopper 15 to create linear (horizontal) movements of the cogged stopper 15. Each of the cogged stoppers 15 has a hollowed portion 16 that substantially matches a part of perimeter of the ball passage 44.

Figure 2B:
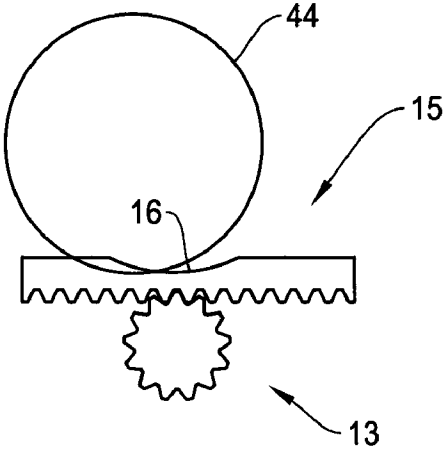

Referring now to FIG. 2B, the condition is explained where a ball is stopped by obstructing the ball passage 44 by the cogged stopper 15. As shown, the cogged stopper 15 moves in the horizontal direction as the gear wheel 13 rotates. In this example, the hollowed portion 16 of the cogged stopper 15 does not fit with the circumference of the ball passage 44. Likewise, in FIG. 2D, the hollowed portion 16 of the cogged stopper 15 does not fit with the circumference of the ball passage 44.

Thus, the passage for the ball through the ball passage 44 is obstructed. The conditions depicted in FIGS. 2B and 2D serve functionally same purpose of stopping the ball from going down. This obstructed condition exists at the lower cogged stopper 15*b* in FIG. 1A and at the upper cogged stopper 15*a* in FIG. 1B. In other words, the upper cogged stopper 15*a* and the lower cogged stopper 15*b* are in the opposite conditions with one another and alternately change the conditions by the operation of the gear 13.

Figure 2C:
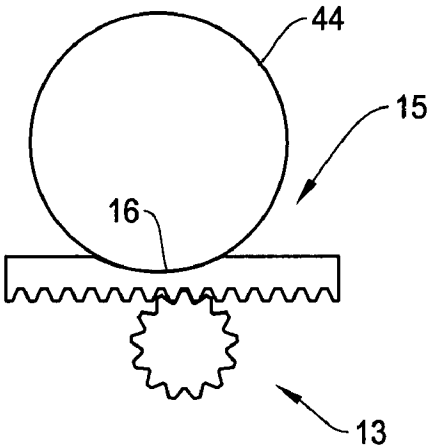
Figure 2D:
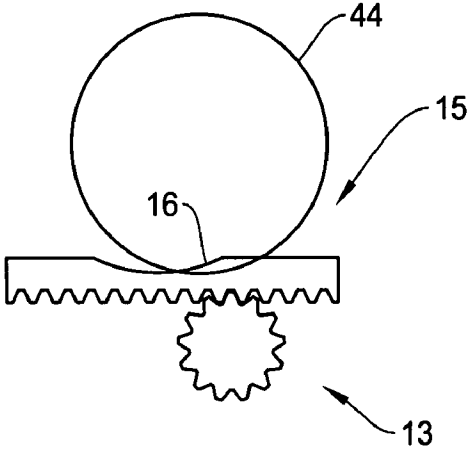

FIG. 2C shows the intermediate condition between those shown in FIGS. 2B and 2D where the hollowed portion 16 of the cogged stopper 15 fits the circumference of the ball passage 44. This condition allows a golf ball inside the ball passage 44 to move freely downward by its own weight. This free flow condition exists at the upper cogged stopper 15*a* in FIG. 1A and at the lower cogged stopper 15*b* in FIG. 1B.

Figure 3A:
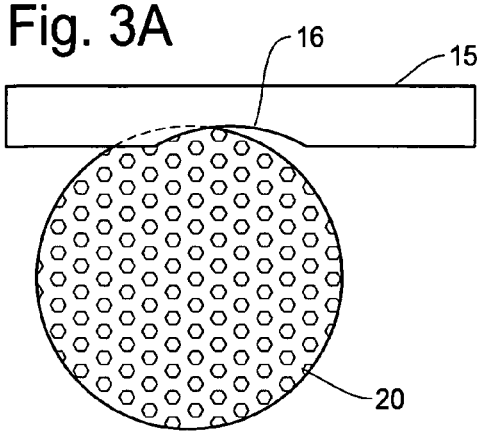
FIG. 3A is a schematic view showing a cogged stopper and a ball where a ball is stopped by the cogged stopper in accordance with the present invention.
Figure 3B:
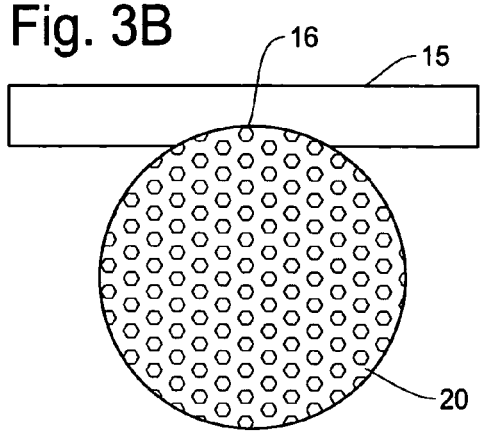
FIG. 3B is a schematic view showing a cogged stopper and a ball where a ball is allowed to pass in accordance with the present invention.
Figure 4A:
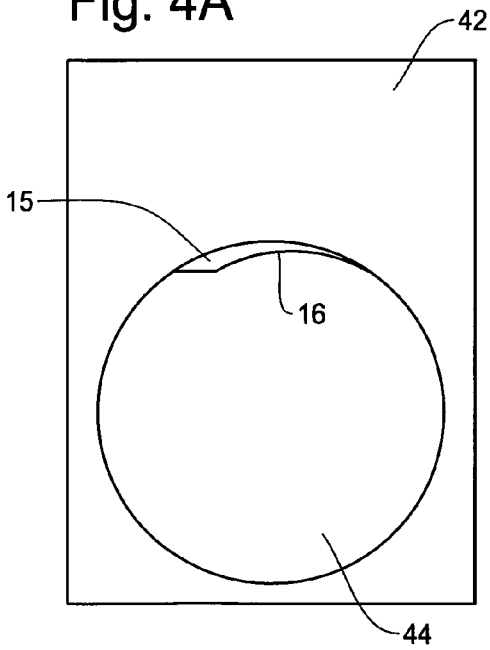
FIG. 4A is a plan view showing a housing, a cogged stopper, and a ball passage in a condition where a ball is stopped in accordance with the present invention.
Figure 4B:
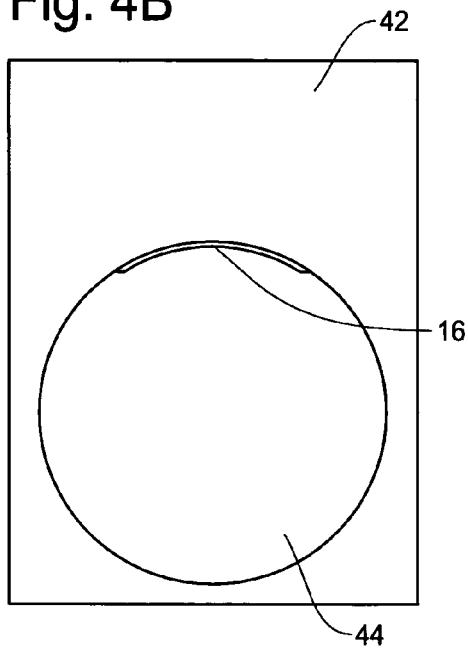
FIG. 4B is a plan view showing a housing, a cogged stopper, and a ball passage in a condition where a ball is allowed to pass in accordance with the present invention.

FIGS. 3A, 3B, 4A and 4B are diagrams showing the more detailed view of the cogged stopper 15 and the ball passage 44. FIGS. 4A and 4B are plan views showing the situation where the cogged stopper 15 is installed inside the housing 42. The ball is stopped in the condition shown in FIG. 4A because the hollowed potion 16 of the cogged stopper does not fit the circumference of the ball passage 44. This condition corresponds to the condition shown in FIG. 3A showing the cogged stopper 15 and the ball where a projection of the cogged stopper 15 in the ball passage prohibits the ball 20 from going down. As indicated by the dotted line, the ball is caught by the projection at the end of the hollowed portion 16 of the cogged stopper 15.

In contrast, the ball is allowed to move without obstruction in the condition shown in FIG. 4B because the hollowed potion 16 fits the circumference of the ball passage 44. This condition corresponds to the condition shown in FIG. 3B showing the cogged stopper 15 and the ball 20. The ball 20 is free to move because the hollowed portion 16 of the cogged stopper 15 creates a space for the golf ball 20 to pass through.

Referring back to FIGS. 1A and 1B, the ball drop mechanism of the present invention can drop the balls one by one by stopping an upper ball while releasing a lower ball. In FIG. 1A, the lower ball is stopped because the hollowed portion 16 of the lower cogged stopper 15*b* does not fit the circumference of the ball passage 44, thereby obstructing passage of the ball. When the user moves the cogged stoppers 15*a* and 15*b* in the horizontal direction (toward left) as shown in FIG. 1B, the lower ball can drop to the ground because the ball passage is not obstructed by the lower cogged stopper 15*b*.

On the other hand, the upper cogged stopper 15*a* now obstructs the ball passage 44 to prevent the upper ball from dropping to the ground. Thus, the ball drop mechanism in the present invention can drop the lowermost ball while stopping any upper balls. When the ball is dropped, the condition of the ball drop mechanism returns to the situation shown in FIG. 1A. A spring or other means may be provided to automatically return the cogged stoppers 15 to the position of FIG. 1A.

Figure 5A:
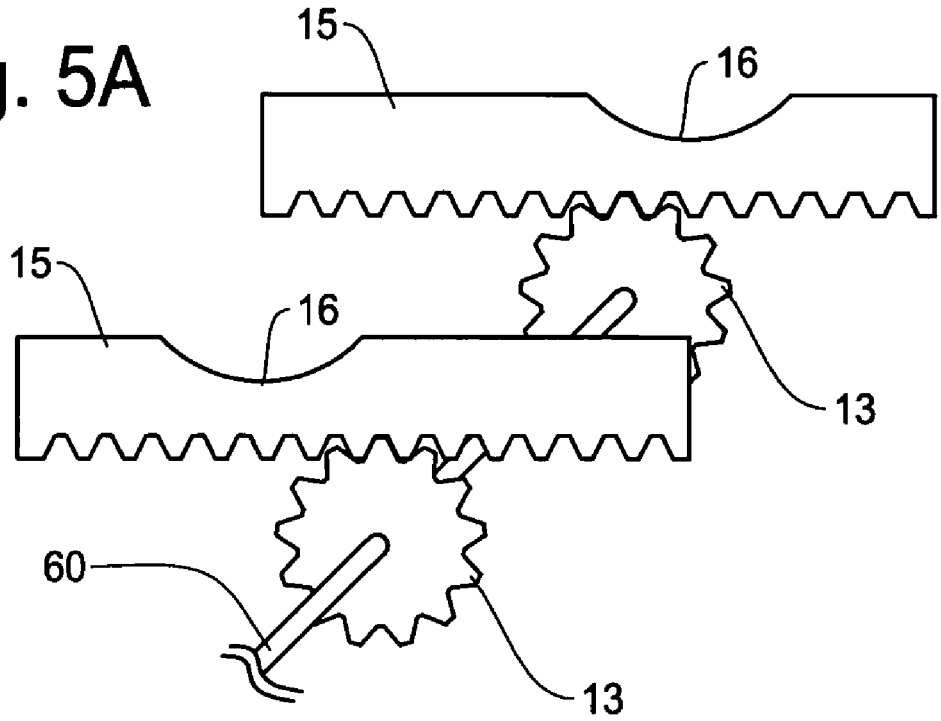
FIG. 5A shows a configuration example of cogged stoppers and gear wheels in the present invention.
Figure 5B:
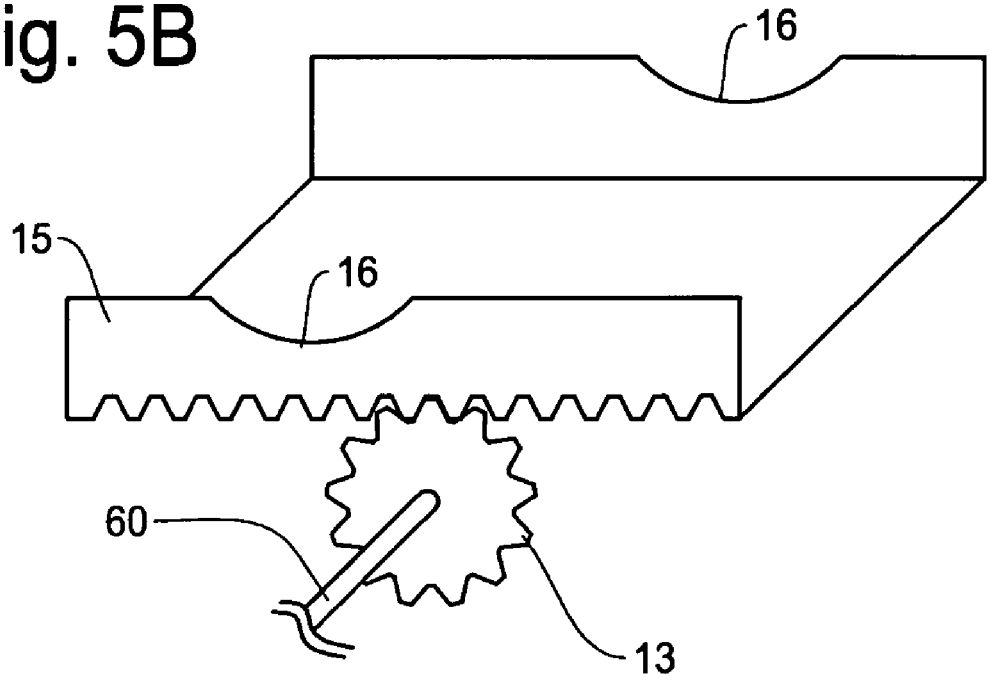
FIG. 5B shows a configuration example of integrated cogged stoppers and gear wheels in the present invention.

As noted above, the upper and lower cogged stoppers 15 are provided and the movement of the cogged stoppers 15 is achieved by the gear wheel. FIG. 5A shows an example that provides two separate cogged stoppers 15 and two separate gear wheels 13. Both of the gear wheels 13 are connected by the shaft 60. Thus, the rotation movement applied to the shaft 60 is transmitted to the gear wheels 13. The movement of the gear wheels 13 is then converted to the linear movement of the cogged stoppers 15. FIG. 5B shows another example of the cogged stoppers 15. In this example, two cogged stoppers 15 are integrally formed by, for example, a metal or plastic plate. Only one gear wheel 13 is provided to move the integrated cogged stopper 15 as a whole.

Figure 6A:
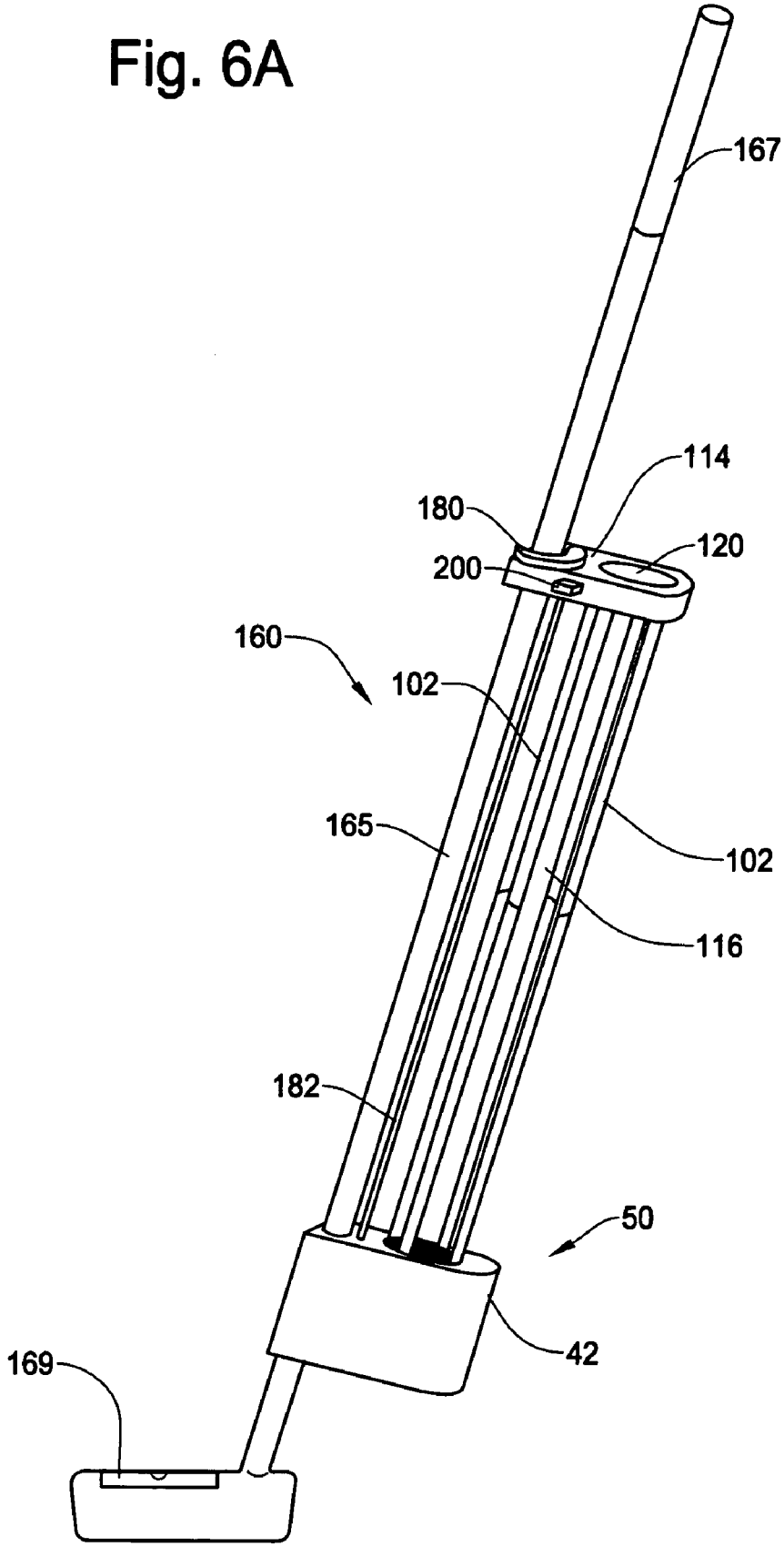
FIG. 6A is a perspective view showing an outer appearance of the ball drop mechanism attached to a golf club having a mechanism for allowing a user to drop balls by turning a handle in accordance with the present invention.
Figure 6B:
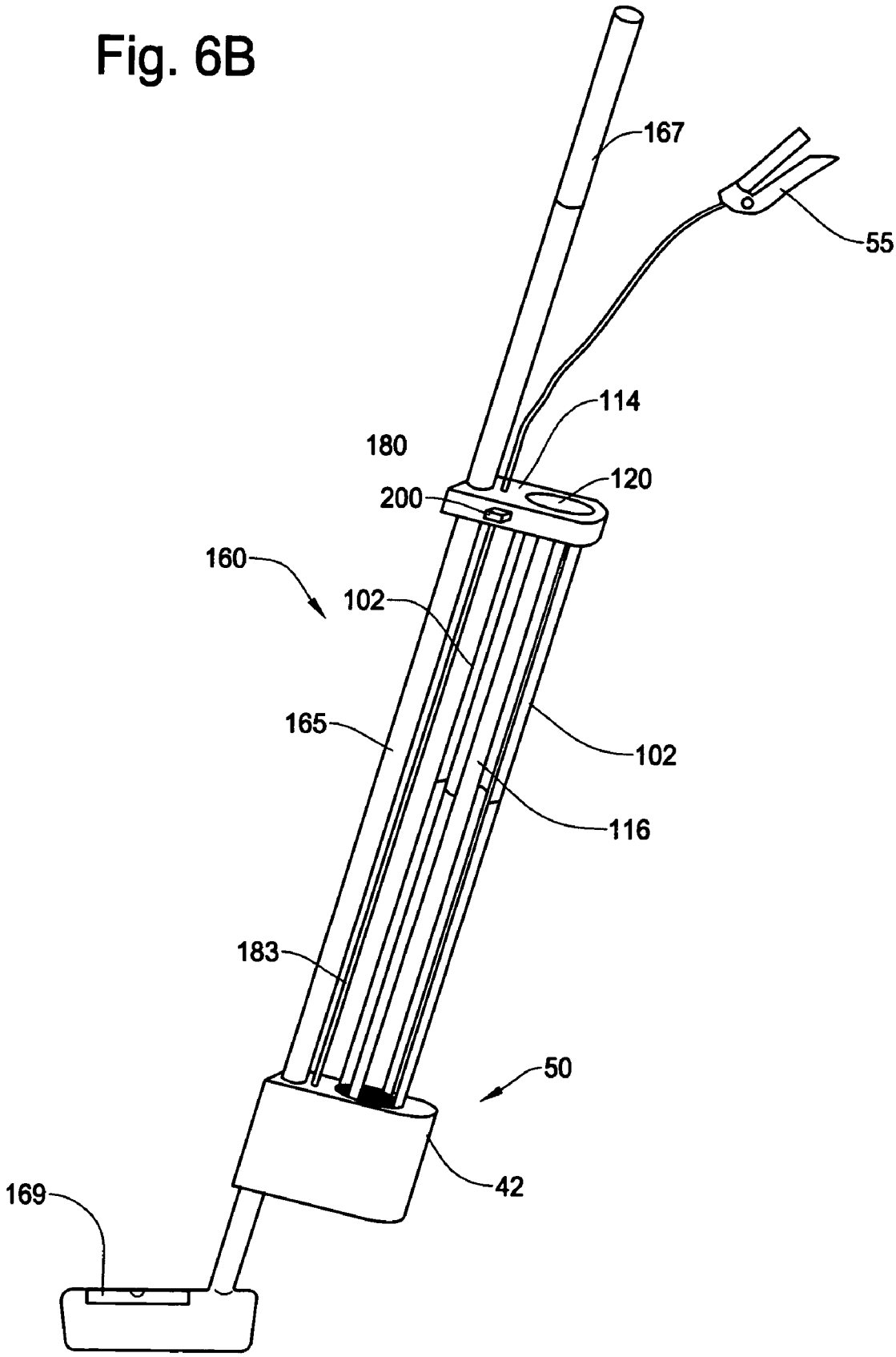
FIG. 6B is a perspective view showing an outer appearance of the ball drop mechanism attached to a golf club having a mechanism for allowing a user to drop balls by gripping a lever in accordance with the present invention.

Next, an embodiment of the ball drop mechanism for game apparatus of the present invention as it is applied to a golf club is described with reference to FIGS. 6A and 6B. In FIGS. 6A and 6B, the ball drop mechanism 50 for game apparatus of the present invention is attached to a golf club 160 such as a putter. The ball drop mechanism 50 is attached to a shaft 165 of the golf club 160 through, for example, screws. The ball drop mechanism 50 of the present invention has an upper support 114 at its upper portion thereof, a housing 42 at its lower portion, and a ball guide (ball storage) 102 in the middle.

The upper support 114 has a ball insertion opening 120 for a user to input the golf balls therethrough. On the upper support 114, a lever 180 is provided to be operated by a user when he wants to drop a golf ball on the ground. Moreover, on the upper support 114, a lock bar 20 is provided to prevent the balls from dropping out from the ball insertion opening 120.

The ball guide 102 stores golf balls, and directs the balls to the housing 42 by the weight of the balls. The ball guide 102 forms a ball passage cylinder 116 for the balls to pass therethrough. Although not specifically shown in the drawings, the ball passage cylinder 116 functions to store a large number of balls. Preferably, the ball passage cylinder 116 has a telescopic structure so that the overall length of the ball passage cylinder 116 can be maximized while overall length is minimized when carrying around.

The housing 42 of the ball drop mechanism of the present invention connects to a drive shaft (drive part) 182 that extends from the upper support 114. The drive part 182 functions to transmit the rotational movement of the lever 180 to the gear wheel 13 inside the housing 42 which drives the pair of cogged stoppers 15. A level 169 may be provided at the head of the golf club to give a visual aid as to a level of the golf club head with respect to the horizontal surface of the ground.

FIG. 6B shows another example that is substantially same as the one shown in FIG. 6A except that a handle (grip) 55 is connected to the upper support 114 to apply a force to the cogged stoppers 15 in the housing 42. The power applied to the handle 55 is transmitted through the power cable (wire) 183 to move the cogged stoppers 15 inside the housing 42. The handle 55 is similar to a one used in a brake lever of a bicycle. It is also possible to utilize an electric power such as a battery and a motor, to move the cogged stoppers 15 in the housing 42. In such an arrangement, a wired switch or a remote controller can be used to initiate the movement of the motor and the cogged stoppers 15. As noted above, the ball guide 102 may be constructed in a telescopic manner so as to extend and shrink to adjust the capacity for installing the balls therein.

Figure 7A:
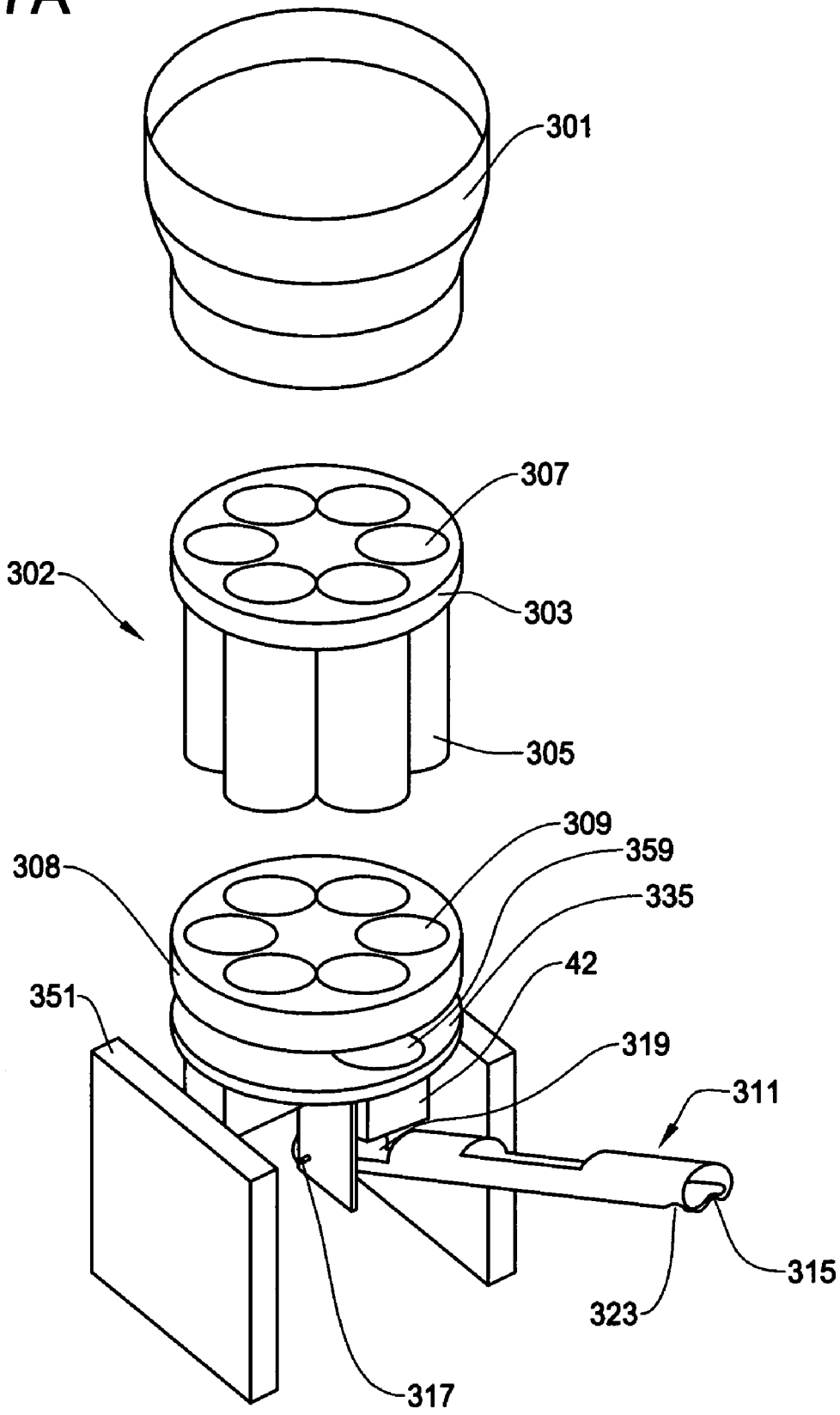
FIG. 7A is an exploded perspective view showing the ball drop mechanism attached to a golf ball dispenser of the present invention where major parts are detached to show the structure of the golf ball dispenser.

The second embodiment of the ball drop mechanism for game apparatus of the present invention as it is applied to a golf ball dispenser is described with reference to FIGS. 7A to 10H. FIG. 7A is an exploded perspective view showing a golf ball dispenser having the ball drop mechanism for game apparatus of the present invention where main components are disassembled. A bucket (hopper) 301 is a container that stores golf balls and guides the golf balls to cylinder halls. In this disassembled condition, the bucket (hopper) 301 does not have a bottom or a fastener, but when assembled, a holder disk 303 acts as a bottom of the bucket 301 as will be explained with reference to FIG. 7B. A plurality of golf ball cylinders 305 are provided to a cylinder holder 302. Cylinder holes 307 are provided on a holder disk 303 each being connected to the corresponding golf ball cylinder 305.

A rotary disk 308 is mounted on a golf dispenser stand and can be rotated about its center. The housing 42 of the ball drop mechanism is provided at the bottom of a base disk 335. As shown in FIGS. 1A and 1B, the housing 42 has the upper and lower stoppers 15 to drop the golf ball one by one.

The base disk 335 has an opening (through hall) 359 through which a ball can pass to the housing 42 from one of the rotary disk holes 309. A stand 351 supports the overall golf ball dispenser.

A ball placer 311 receives a golf ball dropped from the housing 42 and places a golf ball to a desired spot. The ball placer 311 is comprised of a ball stopper 315 to prevent the ball from going further, a drop hole 323 for dropping the ball therethrough, and a receiver hole 319 for receiving the ball from the housing 42. A hinge pin 317 is provided to allow the ball placer 311 to hingedly turn about the hinge pin 317 by the weight of the ball.

Figure 7B:
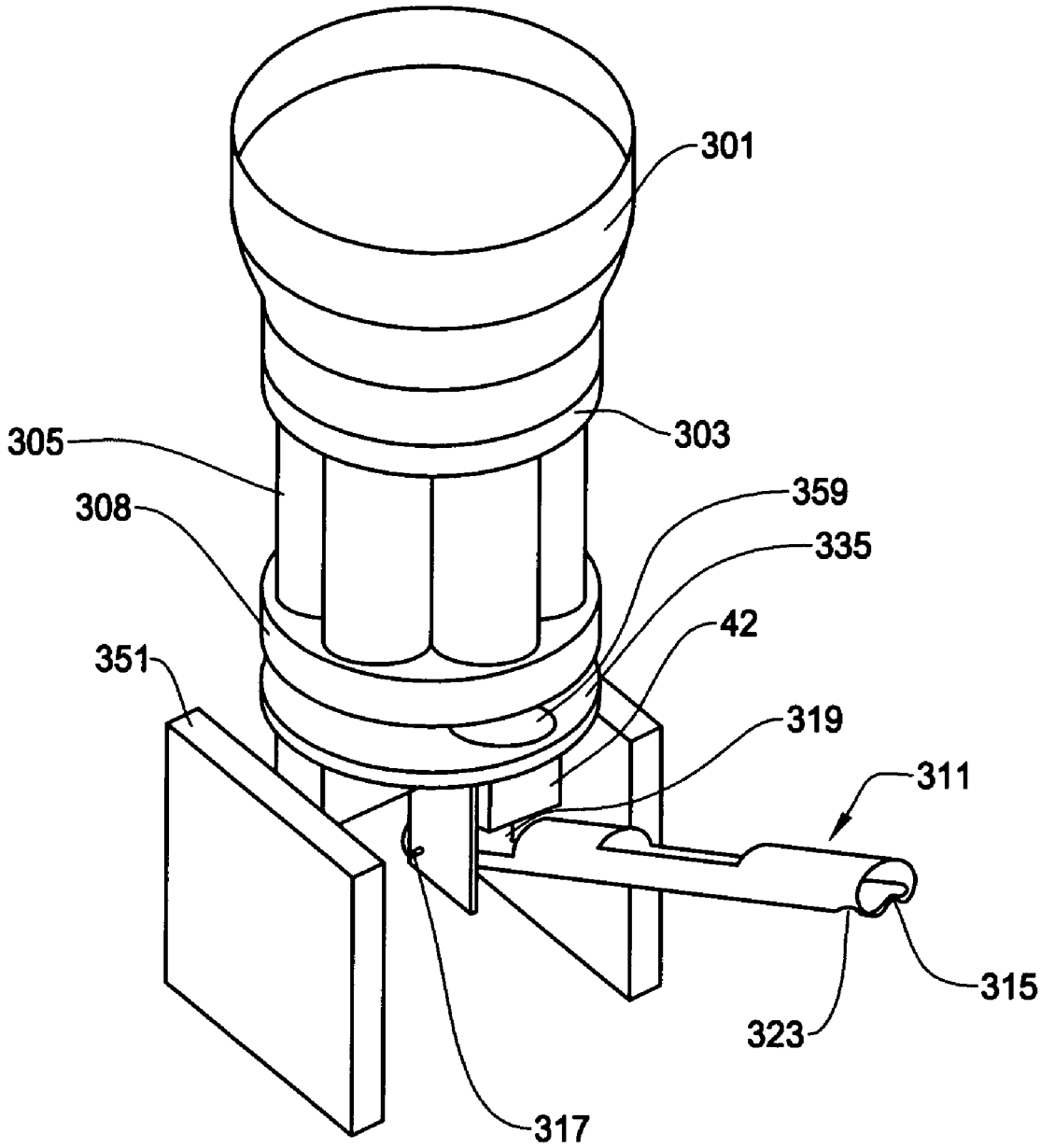
FIG. 7B is a perspective view showing the ball drop mechanism attached to a golf ball dispenser of the present invention where major parts are assembled.

FIG. 7B is a perspective view showing the golf ball dispenser of FIG. 7A having the ball drop mechanism for game apparatus of the present invention wherein main components are assembled. As shown, the bucket 301 is attached to the upper surface of the holder disk 303. Thus, the holder disk 303 acts as the bottom of the bucket 301. When the golf balls are stored in the bucket 301, the ball will gather to cylinder holes 307. The balls will then drop through one of the golf ball cylinders 305. By the own weights of the balls, the balls continuously enter the golf ball cylinders 305 and fill all of the ball cylinders 305 when sufficient number of balls are in the bucket 301. Since the rotary disk 308 can rotate by the user's operation, the cylinder holder 302 and the bucket 301 also rotate along with the motion of the rotary disk 308.

Figure 7C:
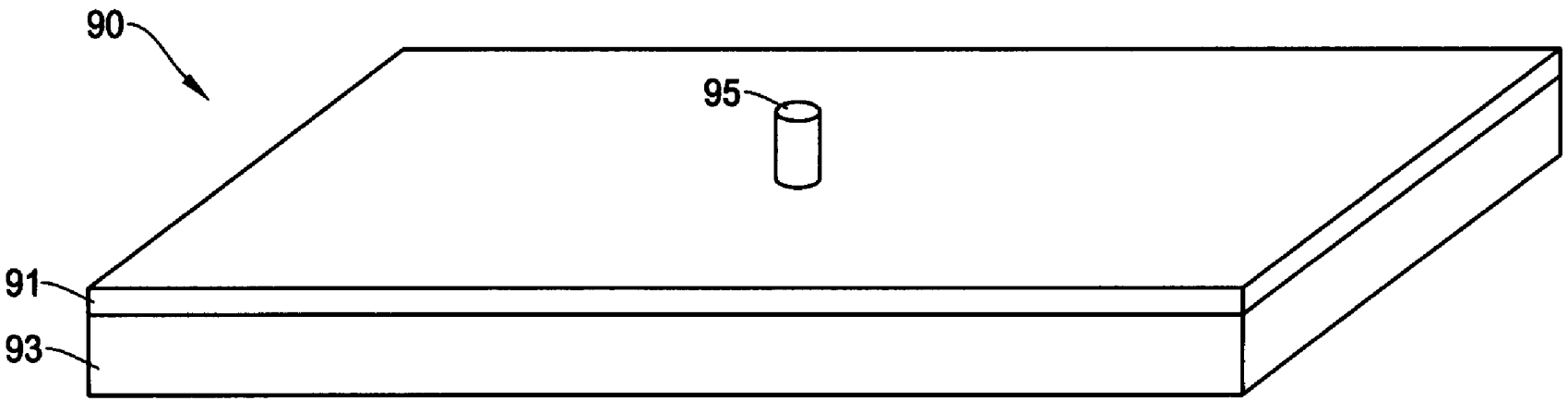
FIG. 7C is a perspective view showing an example of a ball mat of the present invention on which a ball is placed.

The user may place a ball mat on a spot where the golf ball dispenser places a ball to hit the ball. An example of such a ball mat in the preferred embodiment of the present invention is shown in FIG. 7C. In this preferred embodiment, a ball mat 90 is comprised of a fluid container portion 93 and a surface portion 91. A pin 95 may be provided on the upper surface on which a golf ball is placed to practice hit with a driver. The user may also place a ball directly on the surface portion 91. The fluid container portion 93 contains fluid, such as water, jell-like liquid, or air, which establishes shock absorbent property. The shock absorbent property alleviates the shock to the surface portion 91 arises when hitting ball by a golf club. Thus, the user can avoid pain and injury or damage to the club that may be caused by inadvertent hitting of the golf club to the surface portion. The shock absorbent property is also effective to maintain a long life of the ball mat. Although fluid is typically used in the fluid container portion 93 to absorb shocks, other materials, such as powders, sponge, and the like, may also be used to achieve the same objective.

Figure 8A:
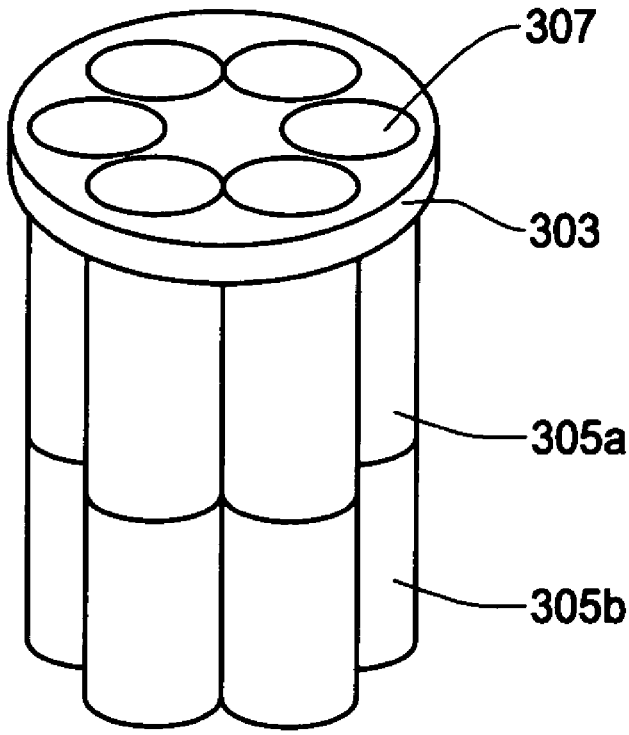
FIG. 8A is a perspective view showing an example of golf ball cylinders in an extended form in the present invention.
Figure 8B:
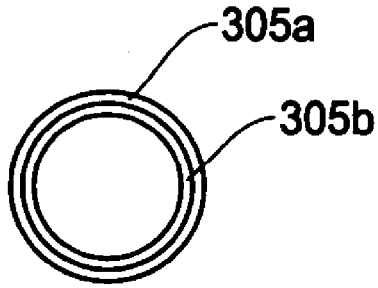
FIG. 8B is a plan view showing an upper cylinder and lower cylinder in the present invention.

The golf ball cylinders 305 may be designed to be extendable as shown in an example of FIG. 8A. In this example, the golf ball cylinders 305 are made of upper cylinders 305*a* and the lower cylinders 305*b* which are telescopically coupled to one another. FIG. 8B is a plan view of one golf ball cylinder 305 in FIG. 8A. In this example, the lower cylinder 305*b* is inside the upper cylinder 305*a*. The lower cylinder can slide out from the upper cylinder 305*b* to form an extended golf ball cylinder 305. This configuration allows the golf ball dispenser to store increased number of balls in the golf ball cylinders 305 while minimizing the size by sliding in the cylinder when carrying the dispenser.

The rotation of the upper portion of the golf ball dispenser helps the balls to reliably enter into one of the golf ball cylinders 305 due to rotation action. Moreover, the user may select to hit a desired type of golf ball by placing different types of balls into different golf ball cylinders 305. For example, the user may store golf balls of particular type or from manufacture in one of the golf ball cylinders 305, while storing other golf balls of different type or from manufacturer in the other golf ball cylinder 305.

Figure 9A:
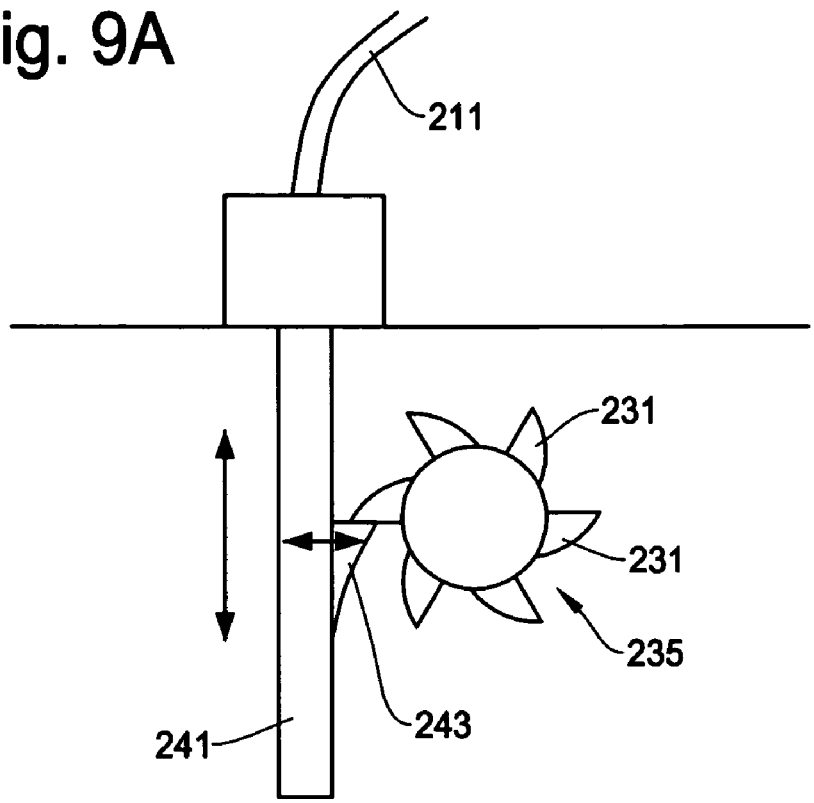
FIGS. 9A–9C are schematic diagrams showing an example of operation for rotating an upper portion of a golf ball dispenser in the present invention to change the positions of the golf ball cylinders.
Figure 9B:
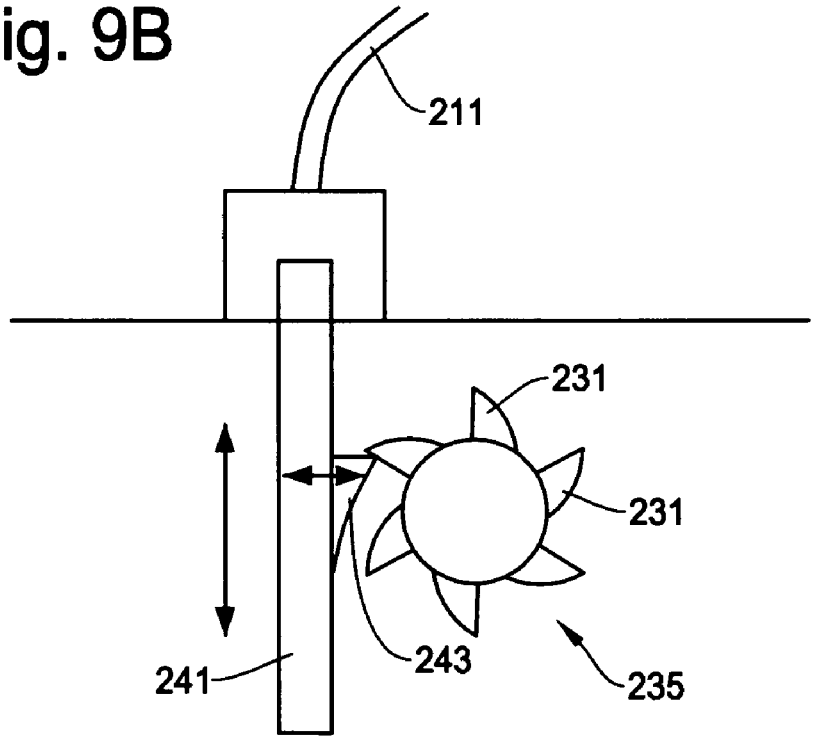
Figure 9C:
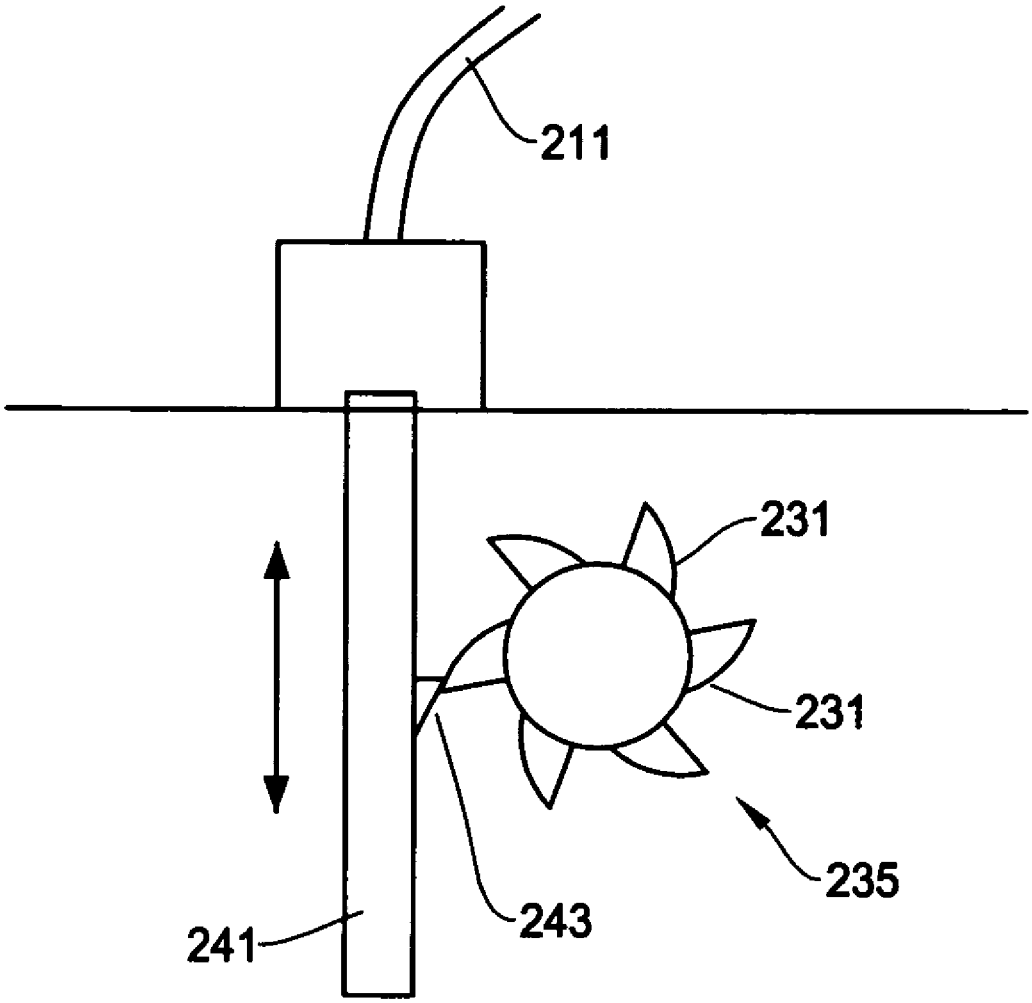

An example to achieve this rotational movement of the upper portion of the golf ball dispenser is shown in FIG. 9A–9C as will be described in detail. However, it is also feasible to eliminate rotation action from this embodiment example so that only one opening is provided at the bottom of the bucket 301 to drop a ball to the ground. This example simplifies the structure and reduces the cost of the golf ball dispenser.

An example for rotating the upper portion of the golf ball dispenser is shown in the schematic diagrams of FIGS. 9A to 9C. FIGS. 9A–9C are top views depicting a cable 211 for transmitting a pulling force, a bar 241 which moves backward and forward by the pulling force from the cable 211, a collapsible nail 243 formed on the bar 241, a drive wheel 235 which rotates by the movement of the bar 241, and cogs 231 formed on the drive wheel.

The bar 241 is able to move in the direction indicated by the longitudinal arrow, i.e., backward and forward direction. The collapsible nail 243 is biased by a spring (not shown) and can be pushed into the bar 241 in the direction indicated by the latitudinal arrow, i.e., left and right direction. The drive wheel 235 is connected to the rotary disk 308 and has a plurality of cogs 231. In this example, six cogs 231 are provided on the drive wheel 235. The number of cogs 231 corresponds to the number of golf ball cylinders 305. Thus, if four golf ball cylinders 305 are provided, the number of the cogs 231 will be four.

On the drive wheel 235, an upper portion of the golf dispenser is placed. Thus, the rotational movement of the wheel 235 is transmitted to the upper portion of the golf ball dispenser to rotate the rotary disk 308. FIG. 9A shows a condition where the drive wheel 235 is in a steady position. Preferably, the drive wheel 235 is latched in this position by a spring (not shown) or other mechanism and will not move unless a certain amount of force is applied to the drive wheel 235.

FIG. 9B shows the condition where the bar 241 makes a lateral movement by the pulling force from the cable 211. The collapsible nail 243 engages and moves one of the cogs 231 to rotate the drive wheel 235. The length of the movement of the bar 241 is adjusted to rotate the drive wheel by the amount to accurately position the next golf ball cylinder 305 on the through hole 359. FIG. 9C shows a condition where the bar 241 is in the process to return to the steady condition by, for example, the force of a spring (not shown). Due the gentle slope of the collapsible nail 243 and one side of the cog 231, the collapsible nail 243 is pushed into the bar 241. In this manner, when the bar 241 is moved to the position of FIG. 9B and returned to the normal position of FIG. 9C, one cycle of operation for the drive wheel 235 (rotary disk 308) ends.

Figure 10A:
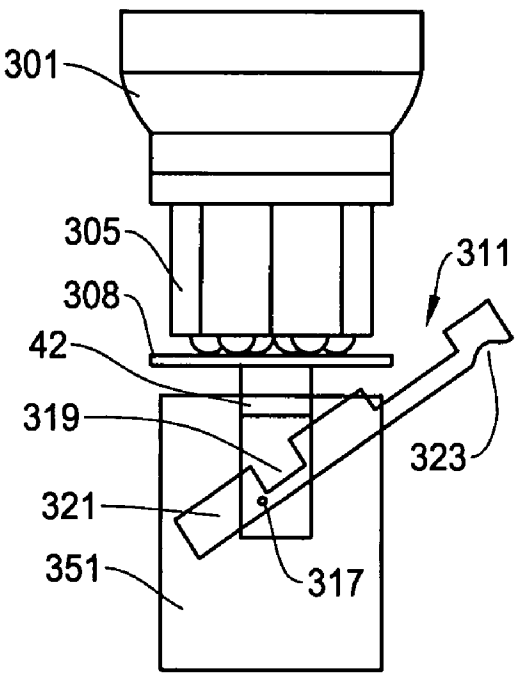
FIGS. 10A–10H are schematic diagrams showing the operation of the golf ball dispenser in the present invention.

The operation of the golf ball dispenser is explained with reference to FIG. 10A to FIG. 10H which are schematic views showing the procedure of the operation of an embodiment of the golf ball dispenser in accordance with the present invention. As describe above, the upper portion (rotary disk 308 mounting the golf ball cylinders 305) of the golf ball dispenser is able to rotate. FIG. 10A shows the condition where the upper portion is being rotated. The ball placer 311 has the drop hole 323 and the receiver hole 319. Although not shown in FIGS. 10A to 10H (but shown in FIG. 7A), the ball stopper 315 is provided at the end of the ball placer 311. The hinge pin 317 connects the ball placer 311 to the golf ball dispenser, and allows the ball placer 311 to turn about the hinge pin 317. The tail portion 321 of the ball placer 311 is designed to have an appropriate weight so that in normal condition, the tail portion 321 is tilted down. Here, the normal condition refers to the condition where a golf ball is not dropped from the housing 42.

Figure 10B:
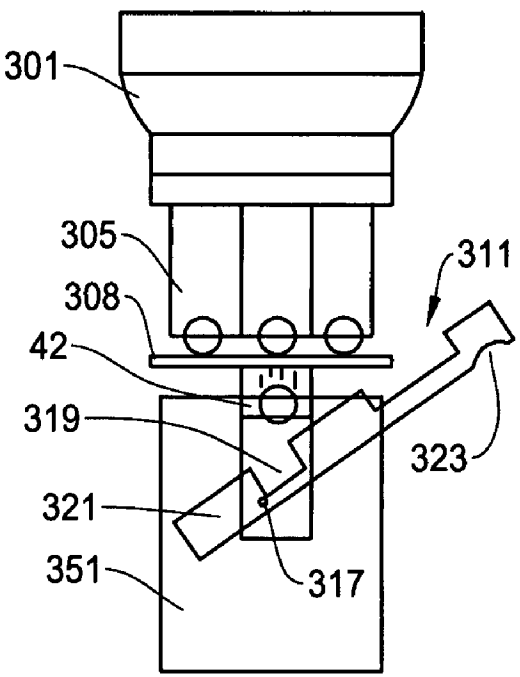

FIG. 10B is a schematic view of the golf ball dispenser of the present invention showing the condition wherein a ball is being dropped from the housing 42 of the ball drop mechanism. Although the details of the housing 42 of the drop mechanism is not shown in FIGS. 7A to 7H, the housing 42 described above is installed and can drop a golf ball one by one. Thus, when the user operates a lever (similar to that of FIG. 6A) or a pedal (not shown) to move the cogged stoppers 15 in the ball drop mechanism, the ball drops from the housing 42.

Figure 10C:
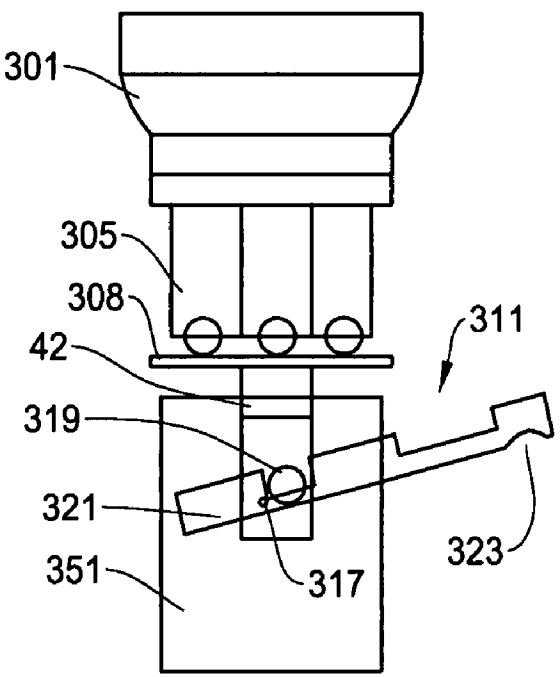

FIG. 10C is a schematic view of the golf ball dispenser in the present invention showing the condition where a ball is dropped to the receiver hole 319 of the ball placer 311. As noted above, the tail end 321 has the appropriate weight so that it tilts to the tail end 321 in the normal condition. However, since the golf ball has now contacted the ball placer 311, the ball placer 311 begins to tilt toward the drop hole 323 because of the weight of the golf ball that is now placed at the right side of the hinge pin 317 as shown in FIG. 10C.

Figure 10D:
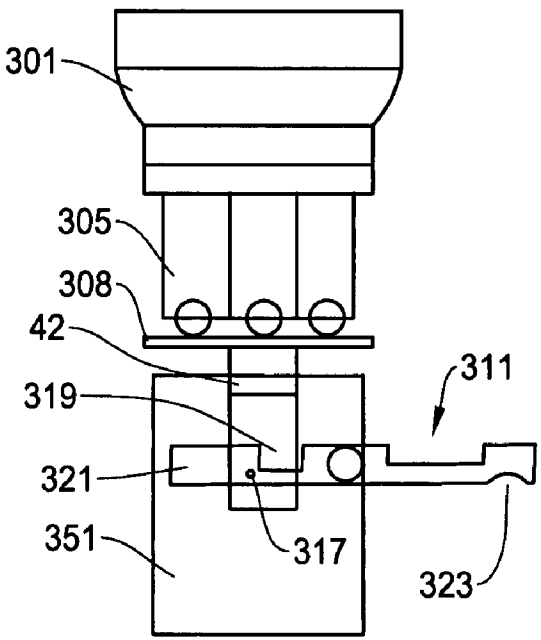
Figure 10E:
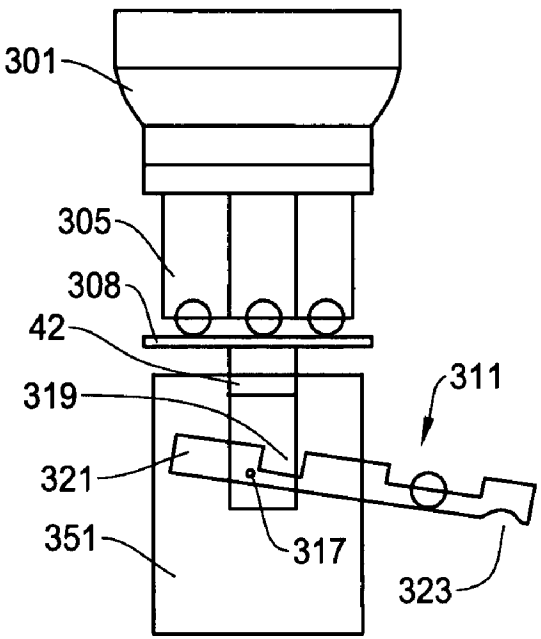

FIG. 10D is a schematic view of the golf ball dispenser in the present invention showing the condition where the ball placer 311 is further tilted toward the drop hole 323. As the ball placer 311 is tiled, the ball moves to the direction of the drop hole 323 which further promotes the ball place 311 so that the drop hole 323 moves down quickly. FIG. 10E is a schematic view of the golf ball dispenser in the present invention showing the condition where the ball placer 311 is further tilted and the golf ball further moved to the drop hole 323. The ball begins to reach the drop hole 323.

Figure 10F:
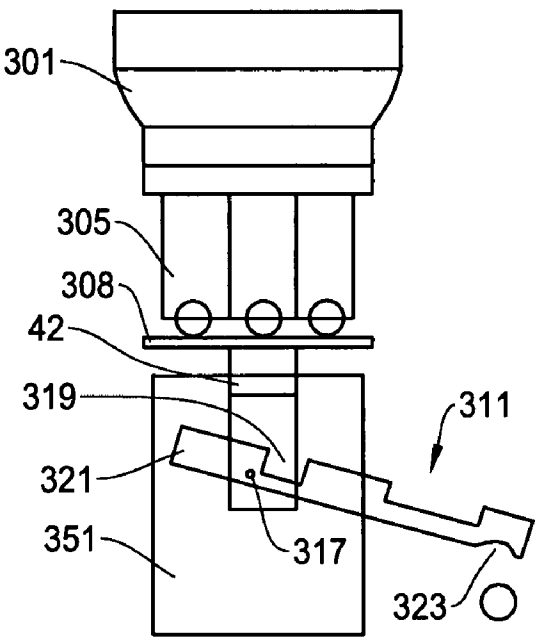
Figure 10H:
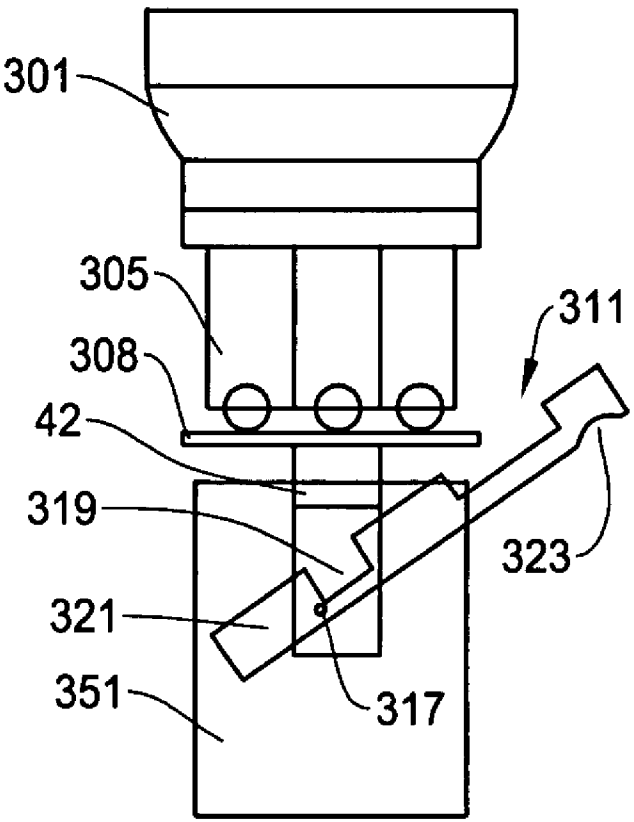

FIG. 10F is a schematic view of the golf ball dispenser in the present invention showing the condition where the ball is dropped from the drop hole 323 to the ground. As noted above, because the ball stopper 315 is provided at the end of the ball placer 311, the golf ball is prevented from proceeding. The drop hole 323 is large enough to allow the golf ball to pass through. The ball will drop to the ground through the drop hole 323 since it has nowhere else to go.

Figure 10G:
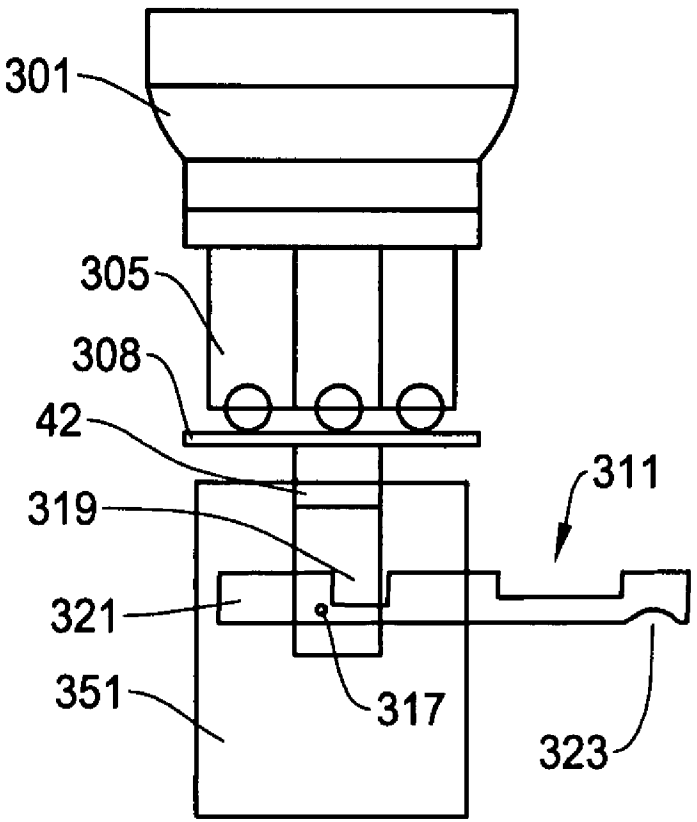

As the ball is dropped to the ground, the ball placer 311 begins to tilt back to the tail end 321 because the balance tips to the tail end 321 as shown in FIG. 10G. The golf ball dispenser will eventually return to the normal condition as shown in the schematic diagram in FIG. 10H. Thus, the golf dispenser in the present invention can place a golf ball one by one at a desired location with accuracy. As described above, each time a ball is dropped from the housing 42, the ball placer 311 makes a seesaw movement to place a ball at an accurate location. By carefully placing the ball mat 90 so that the pin 95 is right under the drop hole 323 when the ball is to be placed, the golf ball dispenser in the present invention can accurately place the golf ball onto the pin 95.

As has been described above, according to the present invention, the (spherical object) drop mechanism is able to drop the ball one by one on a desired location on the ground. The ball drop mechanism of the present invention can be mounted on a golf club such as a putter to promote putting practice using many golf balls. The ball drop mechanism of the present invention can be mounted on a golf ball dispenser which installs a large number of golf balls and drops the ball one by one. Since the ball drop mechanism of the present invention is configured by a simple structure, it can achieve high reliability, low cost, ease of production, and less need of maintenance. Accordingly, it is able to produce the spherical object drop mechanism of the present invention at low cost, with lightweight and durability.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A spherical object drop mechanism for game apparatus, comprising:

a housing into which at least one ball is stored to be later dropped to ground;

a ball passage that is a cylinder provided to said housing having an opening diameter size that is slightly larger than a diameter of a ball to be used;

an upper cogged stopper that is located in an upper position of said housing near said ball passage as to cut across a part of said ball passage, the upper cogged stopper having a hollowed portion that matches a part of a ball's diameter;

a lower cogged stopper that is located in a lower position of said housing near said ball passage as to cut across a part of said ball passage, the lower cogged stopper having a hollowed portion that matches a part of a ball's diameter; and a gear wheel having teeth that engage with a cogged portion of at least one of said upper and lower cogged stoppers;

wherein a positional gap exists between said hollowed portion of said upper cogged stopper and said hollowed portion of said lower cogged stopper such that when said upper cogged stopper allows a ball's movement, said lower cogged stopper stops the ball's movement, and when said lower cogged stopper allows a ball's movement, said upper cogged stopper stops the ball's movement.

2. A spherical object drop mechanism for game apparatus as defined in claim 1, further comprising means to drive the gear wheel to move said upper and lower cogged stoppers.

3. A spherical object drop mechanism for game apparatus as defined in claim 2, wherein said means to drive said gear wheel is a lever manually operated by a user to rotate the gear wheel.

4. A spherical object drop mechanism for game apparatus as defined in claim 3, wherein said cogged stopper automatically returns to a default condition when a user releases said lever.

5. A spherical object drop mechanism for game apparatus as defined in claim 1, further comprising:

a golf club to which said housing is attached, a ball guide attached above said housing along a shaft of said golf club to store balls and guide said stored balls to said housing.

6. A spherical object drop mechanism for game apparatus as defined in claim 5, further comprising a level on a head of the golf club to give a user a visual aid as to a level of the golf club with respect to a horizontal surface.

7. A spherical object drop mechanism for game apparatus, comprising:

a housing into which at least one ball is stored to be later dropped to ground;

a ball passage that is a cylinder provided to said housing having an opening diameter size that is slightly larger than a diameter of a ball to be used;

an integral stopper having an upper stopper and a lower stopper integrally formed with one another where the upper stopper is located at an upper position of said housing and has a hollowed portion that matches a circumference of the ball passage and the lower stopper is located at a lower position of said housing and has a hollowed portion that matches a circumference of the ball passage; and a gear wheel having teeth that engage with a cogged portion of said integrated stopper to transmit a force to the integrated stopper;

wherein a position of said hollowed portion of said upper stopper and a position of said hollowed portion of said lower stopper are shifted so that when said upper stopper allows a ball's movement, said lower stopper stops the ball's movement, and when said lower stopper allows a ball's movement, said upper stopper stops the ball's movement.

8. A spherical object drop mechanism for game apparatus as defined in claim 7, further comprising means to drive the gear wheel to move said integral stopper.

9. A spherical object drop mechanism for game apparatus as defined in claim 8, wherein said means to drive said gear wheel is a lever manually operated by a user to rotate the gear wheel.

* * * * *